US008864294B1

(12) United States Patent
Leighton et al.

(10) Patent No.: US 8,864,294 B1
(45) **Date of Patent: *Oct. 21, 2014**

(54) CONTAINER FOR DELIVERING SOLID-INK PELLETS

(71) Applicant: Xerox Corporation, Norwalk, CT (US)

(72) Inventors: Roger Leighton, Hilton, NY (US); David Lomenzo, Pittsford, NY (US); Patrick Walker, Wilsonville, OR (US); Michael Brundige, Rochester, NY (US); William H. Wayman, Ontario, NY (US)

(73) Assignee: Xerox Corp., Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/887,330

(22) Filed: May 5, 2013

Related U.S. Application Data

(62) Division of application No. 12/848,136, filed on Jul. 31, 2010, now Pat. No. 8,454,147.

(51) Int. Cl.
*B41J 2/175* (2006.01)

(52) U.S. Cl.
CPC ..... *B41J 2/17593* (2013.01)
USPC ..... 347/88; 347/85

(58) Field of Classification Search
CPC ..... B41J 2/175; B41J 2/17593
USPC ..... 347/84, 85, 88, 99
See application file for complete search history.

(56) References Cited

U.S. PATENT DOCUMENTS

| | | | | |
|---|---|---|---|---|
| 6,665,505 | B2 * | 12/2003 | Meetze et al. | 399/106 |
| 7,380,928 | B2 * | 6/2008 | Leighton | 347/99 |
| 7,887,173 | B2 * | 2/2011 | Jones | 347/88 |
| 8,240,830 | B2 * | 8/2012 | Jones et al. | 347/88 |
| 8,454,147 | B2 * | 6/2013 | Leighton et al. | 347/88 |
| 8,579,426 | B2 * | 11/2013 | Deshiikan et al. | 347/88 |

* cited by examiner

*Primary Examiner* — Anh T. N. Vo
(74) *Attorney, Agent, or Firm* — Joseph E. Root

(57) ABSTRACT

The present disclosure provides systems and methods for supplying solid-ink pellets from a container to an image-forming device. The system includes a delivery tube within the container, with one or more openings to receive solid-ink pellets from the container. An agitating structure coupled to the delivery tube disturbs the solid ink pellets. The movement of the delivery tube moves the agitating structure, resulting in disturbing the solid-ink pellets and maintaining flowability of the pellets to the image-forming device.

8 Claims, 7 Drawing Sheets

CONTAINER FOR DELIVERING SOLID-INK PELLETS

CROSS-REFERENCE TO RELATED APPLICATION

This application is a divisional patent application of application Ser. No. 12/848,136, now U.S. Pat. No. 8,454,147, filed Jul. 31, 2010, entitled "CONTAINER FOR DELIVERING SOLID-INK PELLETS," which application is incorporated herein in its entirety.

TECHNICAL FIELD

The presently disclosed embodiments relate to extraction of solid-ink pellets for imaging, and more particularly to devices that maintain flowability of solid-ink pellets being extracted from a container.

BACKGROUND

An image-forming apparatus, such as a printer, a fax machine, or a photocopier, includes a system for extraction of ink pellets from a container, for delivery to the image-forming apparatus. Conventionally, solid ink or phase change ink printers receive ink in solid form, either as pellets or as ink sticks. The solid ink pellets are placed in a container, and a feeding mechanism transports the solid ink to a heater assembly, which melts the solid ink for jetting onto an imaging-forming device.

In general, solid-ink pellets are stored in a container, and are extracted for print media production, whenever required. A vacuum source pulls the solid-ink pellets from an extraction point of the container, using a vacuum tube. When stored in the container over time, the solid-ink pellets tend to bridge or clump together. Bridging occurs close to the extraction point of the container due to solid-ink particle static charge that prevents motion between the particles. Further, during the prilling process that forms the solid-ink pellets, some ink-pellets may not cool appropriately and may fuse together, resulting in fused ink particle clumps, also referred to as agglomerates. These bridges and agglomerates obstruct consistent flow of solid-ink particles to the image-forming device.

A known approach to this problem aims to break up the bridges and clumps. An existing solution requires manually agitating a container holding solid-ink pellets to disturb the solid-ink pellets, resulting in breakage of the bridges and clumps. In general, the containers store gallons of solid-ink pellets, and manually agitating the container may be cumbersome, requiring human intervention.

It would be highly desirable to have a simple and cost-effective system for maintaining the flowability of solid ink-pellets from a container, breaking up bridges and clumps.

SUMMARY

One embodiment of the present disclosure provides a system for maintaining the flowability of solid-ink pellets from a container to an image-forming device. The system includes a delivery tube with one or more openings for receiving the pellets and an agitating structure configured to disturb the pellets. The rotation of the agitating structure breaks up obstructions to pellet flow. The agitating structure includes a plurality of elongated arms and shear bar structures. The agitating structure may be mounted on the delivery tube such that the rotation of the delivery tube rotates the agitating structure, thereby disturbing the solid-ink pellets and maintaining flowability of the pellets.

Another embodiment discloses a method for maintaining flowability of solid-ink pellets, where a container includes a delivery tube attached with a plurality of arms and shear bar structures. The method generates rotation of the delivery tube, which in turn rotates the plurality of arms and shear bar structure, agitating the solid-ink pellets within the container. The method then generates a suction force to extract the solid-ink pellets from the container through the delivery tube, transferring the solid-ink pellets to the imaging device.

DETAILED DESCRIPTION

The following detailed description is made with reference to the figures. Preferred embodiments are described to illustrate the disclosure, not to limit its scope, which is defined by the claims. Those of ordinary skill in the art will recognize a number of equivalent variations in the description that follows.

Overview

The present disclosure describes various embodiments of a system and a method for delivering solid-ink pellets from a container to an image-forming device. The solid-ink pellets are placed in a container including a delivery tube, which transfers the solid-ink pellets to the image-forming device. The system provides a mechanism to avoid any delivery failures and maintains flowability of the solid-ink pellets from the container. To this end, the system includes an agitating structure attached to the outer surface of the delivery tube, and an actuator coupled to the delivery tube controls the rotation of the delivery tube. The movement of the delivery tube rotates the agitating structure, which in turn disturbs the solid-ink pellets. The disturbances introduced within the container break up obstructions to the flow of solid-ink pellets to the image-forming device, and a suction force, applied to the delivery tube, extracts the solid-ink pellets.

Exemplary Operating Environment

Figure 1:
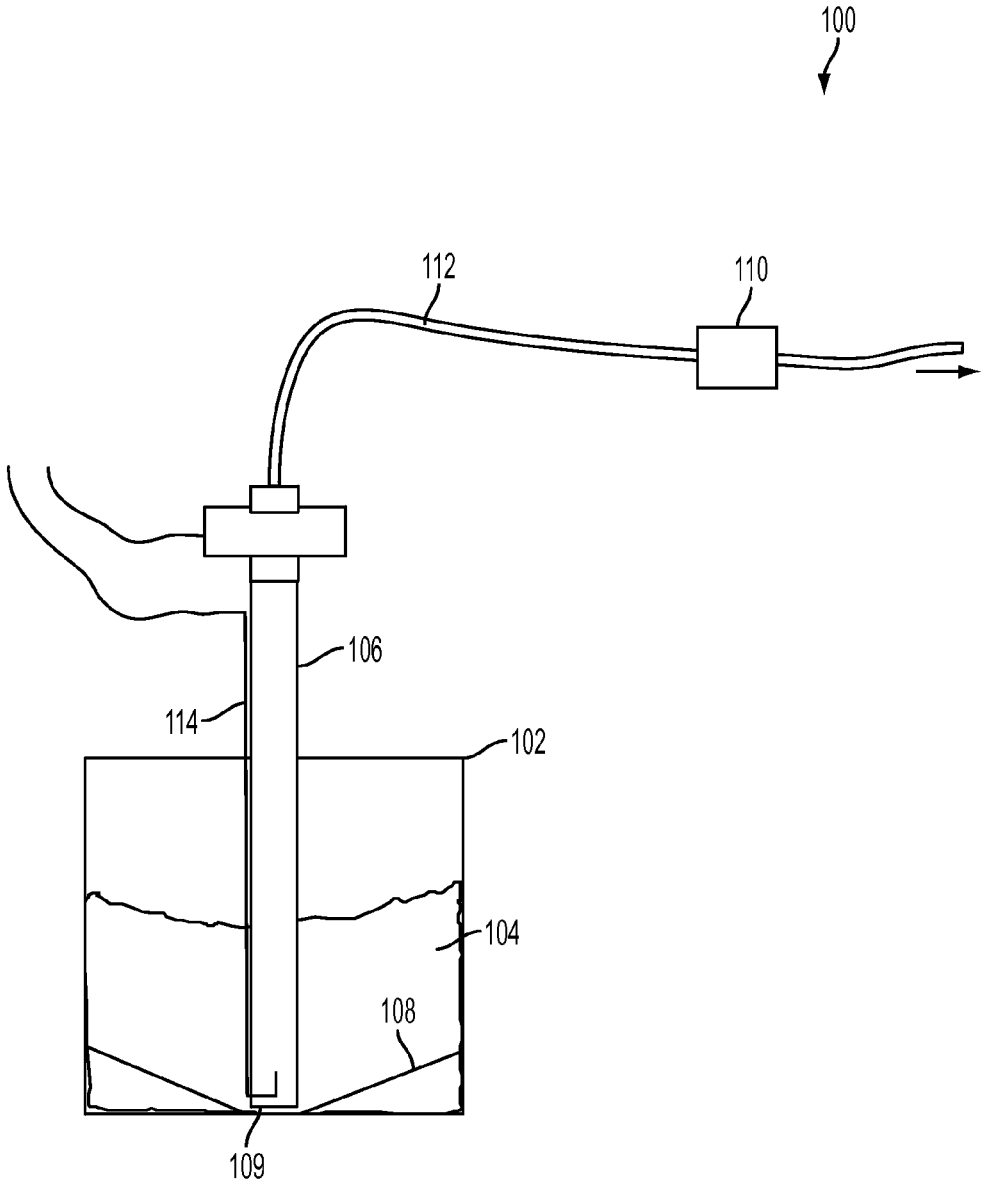
FIG. 1 illustrates an exemplary environment in which a solid-ink pellet delivery system can operate.

FIG. 1 illustrates an exemplary environment 100 for implementing the subject matter of the present disclosure. The environment 100 depicts a conventional delivery system for supplying solid-ink pellets to an image-forming device from a container 102. For purposes of description, the present disclosure is described in connection with solid-ink pellets. Those skilled in the art, however, will appreciate that other environments may similarly require delivery of solid-ink pellets for printing or other purposes, from a storage container or similar device. The technology set out here can also be employed to promote flowability of solid particulates and pellets in a variety of other environments. The container 102 is adapted to receive and store solid-ink pellets 104 or pellet-like objects, and this device can be a container, a box, a cage, a drum, or any other structure for storing. Any rigid material, such as wood, plastic, or metal, may be employed for forming the container 102.

The container 102 includes a delivery tube 106, positioned vertically through an opening in the container 102 that provides a passage for extracted solid-ink pellets 104. As shown, the delivery tube 106 may be attached to the container 102 permanently; however, it should be apparent that the delivery tube 106 might be positioned in the container 102 through the opening whenever solid-ink pellet extraction is required. The delivery tube 106 may be a siphon tube, well known to those skilled in the art. The container 102 may be designed with a tapered conical bottom surface 108 to guide the solid-ink pellets 104 towards the bottom of the container 102, where the bottom end of the delivery tube 106, serves as an extraction point 109 for the solid-ink pellets 104. The conical bottom surface 108 allows gravity flow of solid-ink pellets 104 towards the extraction point 109.

As used herein, the term "tube" includes any generally elongated device having a lengthwise passage formed within, suitable for conveying fluid or particulates. As thus defined, a tube may be formed of any suitable material, and those of skill in the art may deem whatever cross-section useful in a particular application.

To pull the solid-ink pellets 104 from the extraction point 109, the upper end of the delivery tube 106 is connected to a vacuum source 110 through a vacuum tube 112. The vacuum source 110 generates a suction force to extract the solid-ink pellets 104 through the extraction point 109 and may deliver the solid-ink pellets 104 to an image-forming device (not shown) for printing purposes or other known devices utilizing the solid-ink pellets 104. In an embodiment of the present disclosure, the vacuum source 110 may be a venturi system known to those skilled in the art. Further, an airflow, for fluidizing the flow of the solid-ink pellets 104, may also be introduced into the container 102 by way of an assist tube 114. The combination of the suction force and the fluidizing airflow extracts the solid-ink pellets 104 from the container 102. The application of a venturi and an assist tube are well known to those skilled in the art and will not be described in detail here. Alternatively, the container 102 disposed with the delivery tube 106 may be connected to any kind of known source to pull out stored solid-ink pellets 104 or pellet-like objects.

The solid-ink pellets 104 may be liquefiable wax-based pellets. Typically, an image-forming device using solid-ink pellets melts the pellets before passing them to ink jets for printing. In an embodiment of the present disclosure, the diameter of the solid-ink pellet may be about 1-3 mm. The solid-ink pellets 104, stored in the container 102 over time or during the pellet formation process, may conglomerate, forming arches, bridges, or agglomerates, obstructing the extraction path of the solid-ink pellets 104. In general, the size of the solid-ink pellets may range up to a maximum size of about 2 mm.

Exemplary Embodiments

Figure 2:
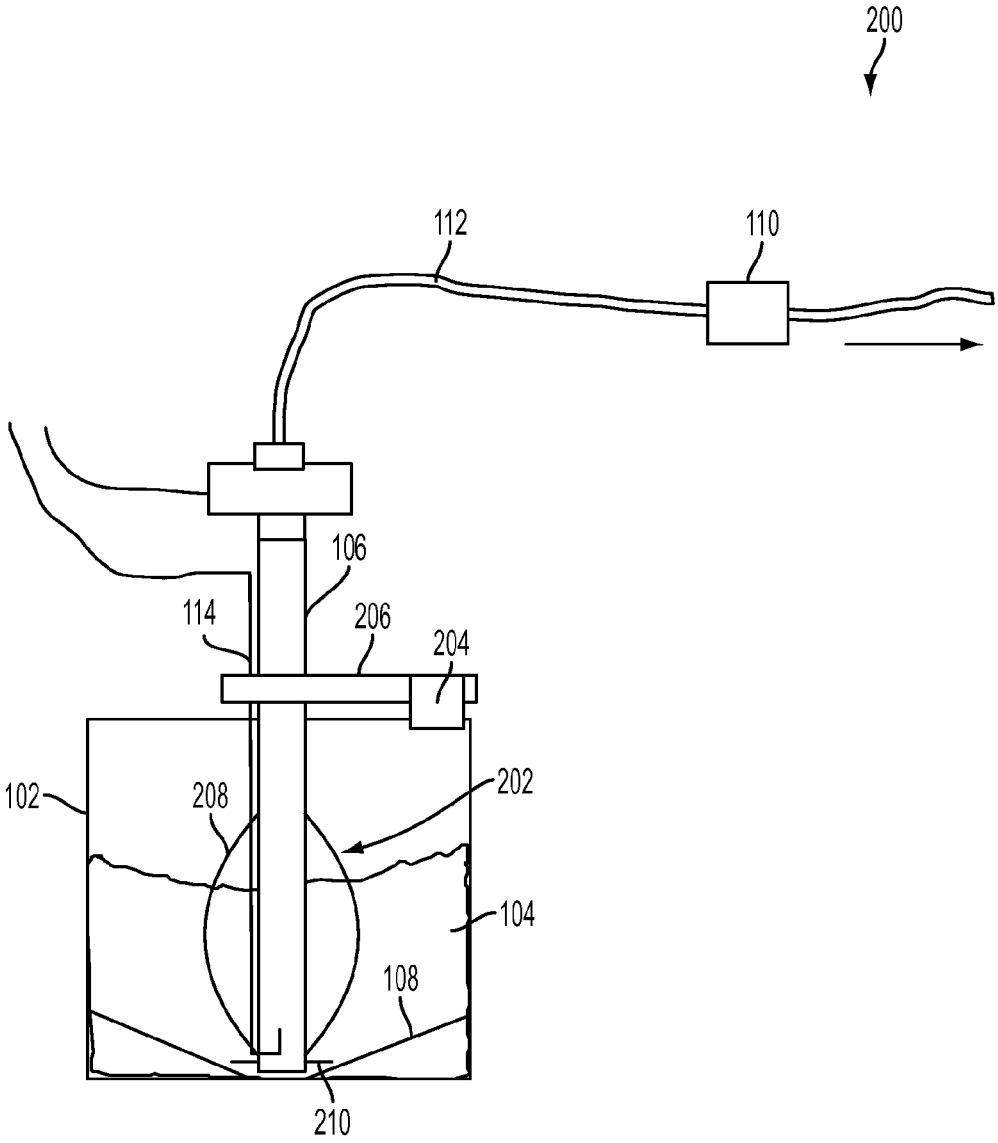
FIG. 2 illustrates an exemplary solid-ink pellet delivery system for supplying solid-ink pellets to an image-forming device from a container.

FIG. 2 schematically illustrates an exemplary embodiment of a system 200 for extracting solid-ink pellets, operating in the exemplary environment 100 depicted in FIG. 1. The system 200 will be generally described here, and its operation generally explained, with a more detailed description set out below. The delivery tube 106 is mounted for rotation within the container 102, and an agitating structure 202 is carried on the delivery tube 106. The ends of the delivery tube 106 may be referred to as an input end, adjacent the bottom of the container 102, and an output end interfaced with a vacuum source 110. In one embodiment, described in detail below, the agitating structure 202 includes arms 208 that are elongated, attached at both ends to the delivery tube 106, and extends arcuately outward from the delivery tube 106, so that the agitating structure 202 resembles a whisk. An actuator 204 is connected to the delivery tube 106 through an actuator arm 206, rotates the delivery tube 106 so that the agitating structure 202 moves through the accumulation of solid-ink pellets 104, breaking up any flow obstacles.

The bottom end of the delivery tube 106 includes one or more inlets (not shown) for extracting the solid-ink pellets 104. Moreover, as explained in more detail below, the bottom end of the delivery tube 106 is adapted for rotation. The upper end of the delivery tube 106 includes a connection to the vacuum source 110, as well as an exterior connection to the actuator arm 206. Other configurations including a rotatable delivery tube with inlets may also be employed here.

The agitating structure 202 includes the arms 208, attached to the outer surface of the delivery tube 106, to disturb the solid-ink pellets 104. In the illustrated embodiment, the arms 208 are generally elongated wire-like or rod-like structures, attached at each end to the delivery tube 106 and extending outward to describe an arc. As noted, the overall makeup of agitating structure 202 resembles a whisk. As shown, the movement of the arms 208 may agitate the surrounding solid-ink pellets 104, separating the coagulated or bridged pellets. To deal with agglomerations underneath the arms 208, in close proximity to the inlets, the system 200 employs multiple shear bar structures 210 connected to the bottom end of the delivery tube 106. Each shear bar 210 extends outward from the delivery tube 106 in the form of a short elongated bar, which agitates the solid-ink pellets 104 near the inlets, breaking up clumps or agglomerates.

Further, the system 300 includes multiple shear bar slots (not shown) through which the shear bar structures 210 pass through, and aid the breaking up of clumps or agglomerations by providing a shearing surface. The slots are manufactured in the form of sheet metal blades or fins, and may be mounted on the container 102. In one embodiment of the system 200, the number of shear bar slots corresponds to the number of shear bar structures 210. The shear bars structures 210 can be mounted on the delivery tube 106 so that the shear bar structures 210 pass through the shear bar slots. In an embodiment of the system 300, the distance between the shear bars structures 210 and the shear bar slots depends on the size of the solid-ink pellets 104, which in the illustrated embodiment is about 2 mm. In general, the slots are structured with a clearance greater than the size of the solid-ink pellets in order to break up agglomerations. Thus, the slots of the illustrated embodiment have a width of about 2.5 mm. Slots may be manufactured in any shape such as square, circular, arc, or other suitable shapes that provide a shearing surface.

As can be seen, the agitating structure 202 is structured to encounter minimal resistance from the solid-ink pellets and thus requires minimal torque from the actuator 204. Alternatively, agitating structure 202 may include structural geometries, such as blades, sheet metal, or pins, that may dislodge the solid-ink pellets 104 with minimum torque required.

The geometry and the movement of the agitating structure 202 may depend on the properties of the solid-ink pellets 104, such as bulk density, size range, melting point, static charge, flowability and so on. Further, the delivery tube 106 can be tailored to these properties; for example, the diameter of the delivery tube 106 may be based on the size range of the solid-ink pellets 104 being extracted.

The actuator 204 rotates the agitating structure 202 using the actuator arm 206, connected close to the top end of the delivery tube 106. As shown, the actuator 204 is connected to the delivery tube 106; it should be apparent, however, that the actuator 204 may be a part of the image-forming device or the container 102 and is detachably connected to the delivery tube 106. The actuator 204 may include a drive motor or an air cylinder. The process of rotating a structure, such as the delivery tube 106, using an actuator is known to those skilled in the art and is not explained in detail. In an embodiment of the system 200, the actuator 204 may rotate the actuator arm 206 about the longitudinal axis of the delivery tube 106. The actuator 204 ensures to rotate the agitating structure 202 substantially to break up the flow barriers with minimum torque. In an embodiment of the present disclosure, a torque value of 5 N-m generated by the actuator 204 may be sufficient to break up the flow obstructions. An exemplary embodiment of the actuator 204 is discussed in the following section in connection with FIG. 3.

Further, the system 200 may include a controller (not shown in FIG. 2), which may initiate the rotation of the agitating structure 202 automatically at a predetermined time. Initiation may be timed to occur at convenient intervals, such as before starting the imaging process, once a day, or as preferred. In certain cases, the actuator 204 engages the delivery tube 106 whenever solid-ink pellet are extracted. Further, the frequency and speed of rotation of the agitating structure 202 may also be determined by the controller.

It will be apparent to those of skill in the art that a number of structural variations can be introduced, all of which produce agitating action by the agitating structure 202 within the solid ink pellets 104. For example, the actuator 204 may be operatively coupled to the agitating structure 202 but not to the delivery tube 106, so that the actuator 204 only rotates the agitating structure 202. In another embodiment, multiple agitating structures 202 may be introduced in the container 102, all driven by actuator 204. Further, the agitating structure 202 may only include the arms 208 or the shear bar structures 210 to break up agglomerations.

As discussed, the system 200 provides a cost effective and an efficient means to maintain the flowability of solid-ink pellets to an image-forming device, avoiding of feeding failures.

Figure 3:
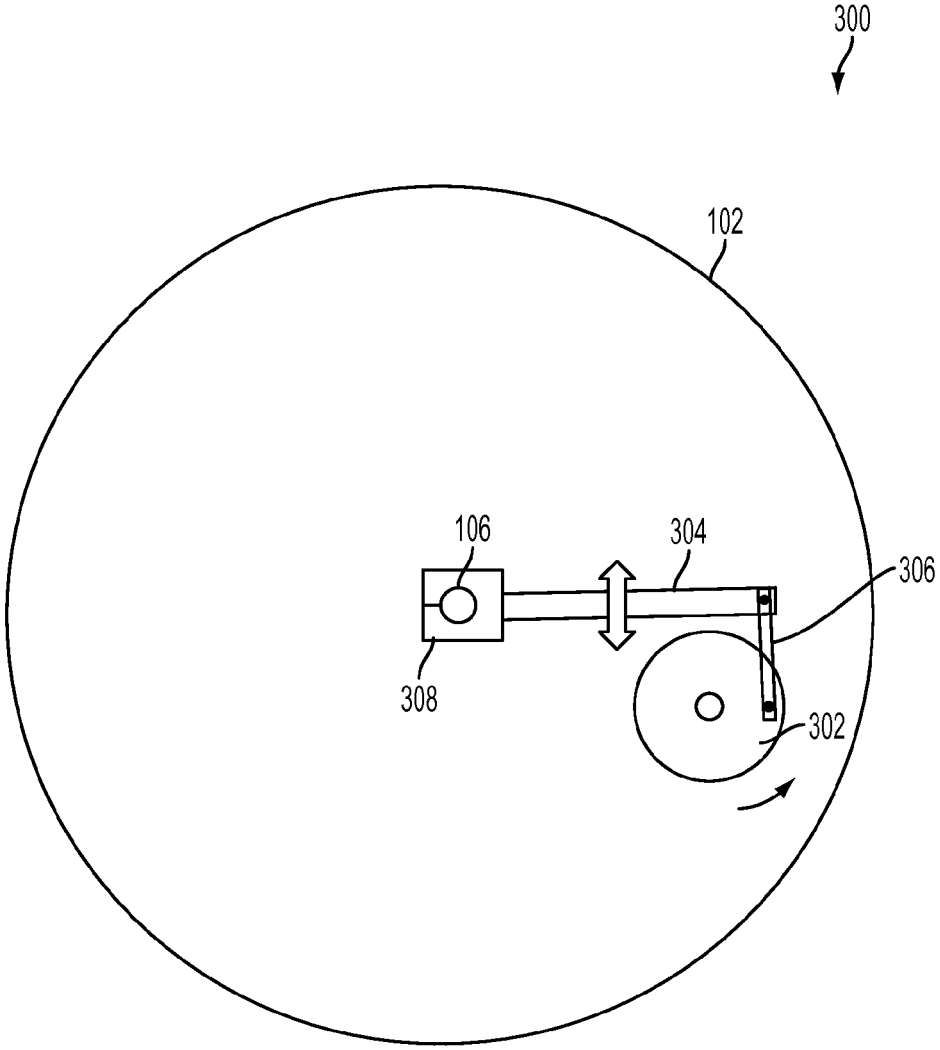
FIG. 3 shows an exemplary embodiment of an actuator coupled to the delivery tube, shown in FIG. 2.

FIG. 3 illustrates the top view of the system 200 employing an exemplary actuator to rotate the delivery tube 106. The embodiment of FIG. 3 depicts a drive motor 302 coupled to a crank 304 through a connecting arm 306. The crank 304 in turn is attached to the delivery tube 106 via a clamp 308. As shown, the drive motor 302 rotates the crank 304, the angle of rotation varying based on the number of shear bar structures 210 or the shear bar slots. For example, if the delivery tube 106 is attached to four equally spaced shear bar structures 210, the tube will require a minimum rotation of 45 degrees, to ensure that the shear bar structures 210 passes through the slot during each oscillation. In one embodiment, the crank 304 is rotated at about 49 degrees about the longitudinal axis, though other rotational angles may be provided.

Figure 4:
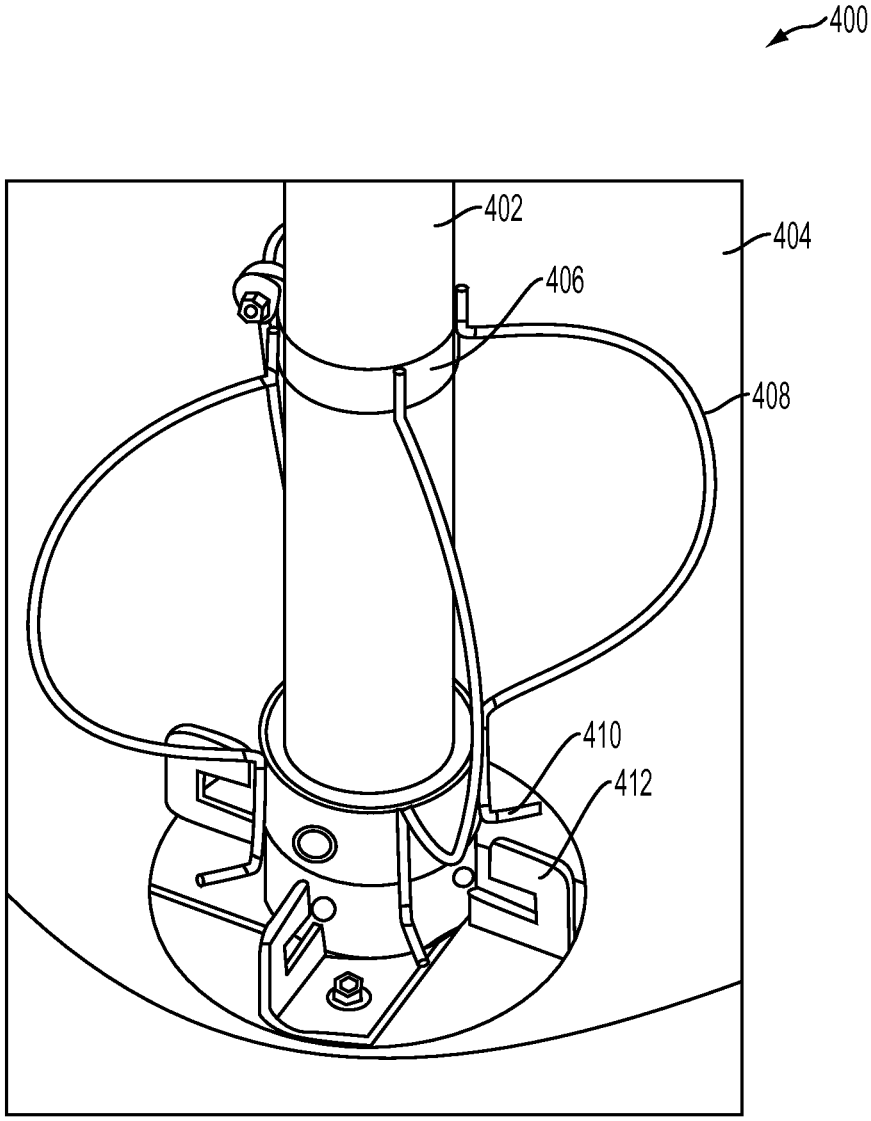
FIGS. 4-6 illustrate different views of an exemplary embodiment of a solid-ink pellet delivery system.

FIGS. 4, 5, 6, and 7 show different views of an exemplary solid-ink pellet delivery system 400. FIG. 4 illustrates a delivery tube 402, disposed within a container 404, attached with an agitating assembly 406 on the outer surface. The embodiment of the solid-ink pellet delivery system 400 depicts the delivery tube 402 with circular cross-section; however, it should be apparent that other known suitable shapes, such as square, rhombus, octagon, and the like, may be employed. The agitating assembly 406 includes four equally spaced breaker bar structures 408 and shear bar structures 410 for generating disturbances. Those in the art will understand that the agitating assembly 406 may include other arrangements of the breaker bar structures 408 and shear bar structures 410. The breaker bar structures 408 and shear bar structures 410 connect to the delivery tube 402 through known fastening mechanisms.

As shown, the breaker bar structures 408 are substantially semi-circularly shaped wire structures disposed on the circumference of the delivery tube 402, such that the two ends of the breaker bar structures 408 are connected in close proximity to the upper and bottom ends of the delivery tube 402, respectively. The breaker bar structures 408 are elongated structures extending acutely outward from the delivery tube 402. Further, the shear bar structures 410 are wired protrusions attached close to the bottom end of the delivery tube 402, such that the shear bar structures 410 are substantially perpendicular to the longitudinal axis of the delivery tube 402. The agitating assembly 406 illustrated here is a wire structure, manufactured from stainless steel with a thickness of 4 mm; it should be apparent, however, that other suitable materials with varying thickness may be employed without departing from the scope of the present disclosure.

Further, the container 404 is attached with a set of shear bar slots 412 allowing the shear bar structures 410 to pass through. The shear bar slots 412, as shown, are in the form of C-shaped slots having slots size greater than the size of the pellet size to break up agglomerations. During each oscillation, the delivery tube 402 requires a minimum rotation of 45 degrees to ensure that the shear bar structures 410 passes through the slot 412.

Figure 5:
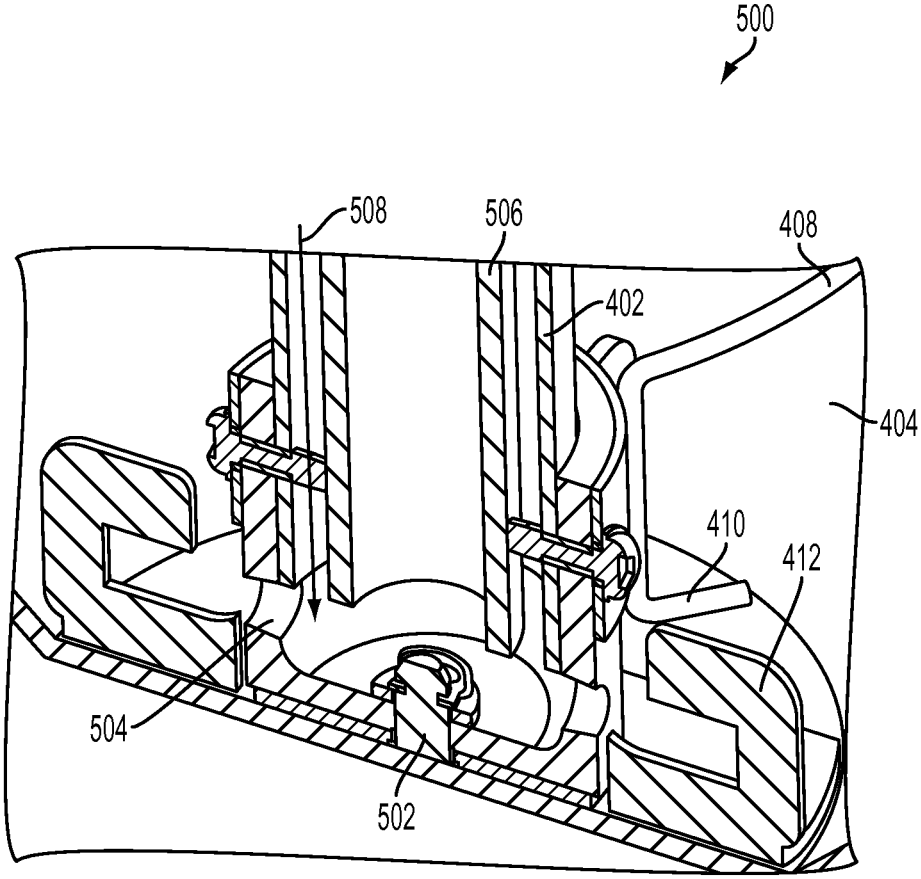

FIG. 5 depicts a cross-sectional view of the exemplary solid-ink pellet delivery system 400. As illustrated, the delivery tube 402 is mounted on the container 404 at a rotation point 502, such that the delivery tube 402 is free to rotate. Further, the delivery tube 402 includes multiple extraction points 504 that provide inlets for receiving solid-ink pellets stored in the container 404. The extraction points 504 are tapered inlets (not shown) with a narrow input end and a wider output end. The narrow input end acts as a filter, allowing only suitably sized solid-ink particles to pass through, while the tapered output end of the extraction points 504 prevent small particles from becoming wedged together and blocking the extraction points 504.

As shown, the delivery tube 402 includes a co-axial extraction tube 506 connected such that the two tubes rotate in tandem. To extract solid-ink pellets stored in the container 404, airflow (depicted by arrow 508) to fluidize the solid-ink pellets is introduced through the annulus between the delivery tube 402 and extraction tube 506. Solid-ink pellets entering the delivery tube 402 through the extraction points 504 are fluidized by this airflow, and drawn up the extraction tube 506 using a vacuum source (not shown).

Figure 6:
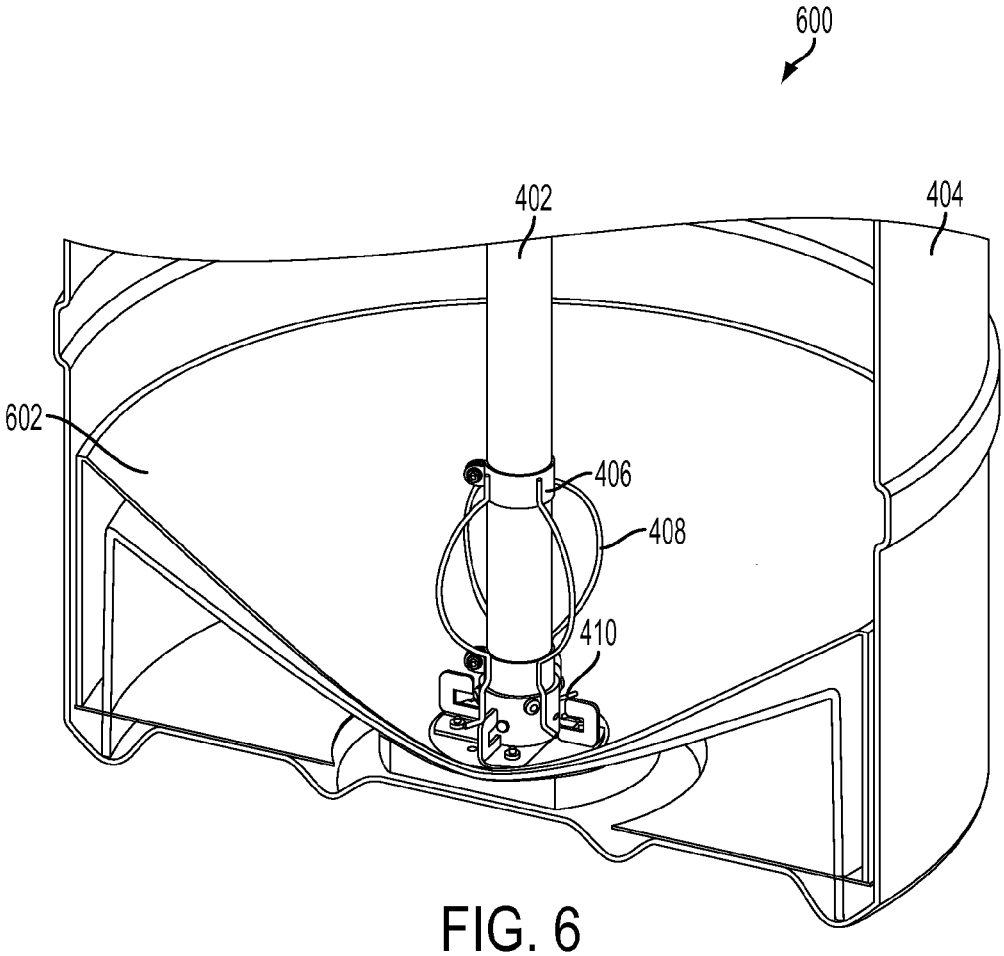

FIG. 6 illustrates a cross-sectional view of the exemplary solid-ink pellet delivery system 400, illustrating an alternative structure of the container 404. As shown, the bottom end of the container 404 is modified here to a conical bottom 602, which allows gravity flow of solid-ink pellets towards the extraction points 504. A rotatable mount, such as the delivery tube 402, is located at the low point of the conical bottom 602, such as the rotatable point 502. The rotatable mount may include any kind of rotatable structures such as the breaker bar structures 408 or the shear bar structures 410. As shown, the shear bar slots 412 having a C-shaped slot structure are positioned adjacent to the mounting position of the delivery tube 402, It should be understood to those skilled in the art that the container 404 disclosed in the delivery system 400 may be adapted to store any pellet-like object known in the art. Further, the rotatably mounted delivery tube 402 may extends into the container 404 with openings 504 for receiving pellet-like objects. The delivery tube 402 may be mounted with an agitating structure, such as the agitating assembly 406, to agitate the pellet-like structures. As discussed, the agitating structure includes one or more elongated arms 408 and shear bar structures 410, along with a set of shear bar slots 412, having C-shaped slot structures, sized and positioned to allow shear bar structures to pass through. In addition, an actuator may be connected to the delivery tube 402 through an actuator arm to rotate the delivery tube 402 which in turn rotates the agitating assembly 406. Those in the art will appreciate that the container 404 may be re-filled with pellet-like objects by any known solutions and any known extraction device may extract the pellet-like objects from the container 404 through the delivery tube 402.

Figure 7:
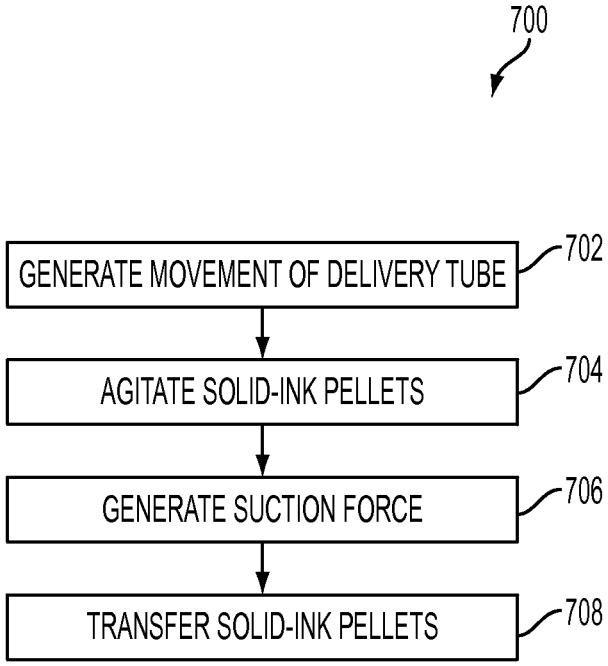
FIG. 7 is a flowchart of an exemplary method for supplying solid-ink pellets to an image-forming device from a container.

FIG. 7 is a flowchart of an exemplary method 700 for delivering solid-ink pellets to an image-forming device from a container, such as the container 102 (shown in FIG. 1). As shown in FIG. 1, the container 102 includes the delivery tube 106 attached with the agitating structure 202.

At step 702, the method 700 rotates the delivery tube 106 using the actuator 204; the rotation of the delivery tube 106 rotates the agitating structure 202. In one embodiment, the actuator 204 rotates the agitating structure 202 on receiving a 'call for pellet' command from the image-forming device, which instructs the container 102 to deliver an uninterrupted flow of solid-ink pellets for imaging purposes.

The movement of the agitating structure 202 agitates the solid-ink pellets within the container 102, at step 704. These disturbances break up bridges, clumps, agglomerates, or any other obstructions formed within the container 102. At step 706, the vacuum source 110 generates a suction force to extract the solid-ink pellets from the container 102, through one or more extraction points, such as the extraction points 504. Finally, at step 708, the extracted solid-ink pellets are delivered to an image-forming device. The container 102 may be refilled with solid-ink pellets through known supplying means. In an embodiment of the present disclosure, bottles of ink weighing less than 40 pounds may be poured onto the top of container 102.

It should be noted that the description below does not set out specific details of manufacture or design of the various components. Those of skill in the art are familiar with such details, and unless departures from those techniques are set out, techniques, designs and materials known in the art should be employed. Those in the art are capable of choosing suitable manufacturing and design details.

The terminology used herein is for the purpose of describing particular embodiments only and is not intended to be limiting of the disclosure. It will be appreciated that several of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A solid-ink pellet container comprising:
- a delivery tube including:
  - an input end with one or more tapered openings; and
  - an output end coupled to a vacuum source providing airflow within the container;
- an agitating structure attached to the delivery tube for introducing disturbances within the container, the agitating structure including:
  - a plurality of arms connected to the central portion of the delivery tube; and
  - a plurality of shear bar structures connected adjacent to the input end of the delivery tube;
- wherein rotation of the delivery tube rotates the agitating structure, thereby introducing disturbances.

2. The container of claim 1, wherein the tapered openings include:
- a narrow end at the outer circumference of the delivery tube; and
- a wider end at the inner circumference of the delivery tube.

3. The container of claim 1 further comprising an actuator, coupled to the delivery tube, configured to control rotation of the delivery tube.

4. The container of claim 3 further comprising a controller for activating the actuator at a predetermined time.

5. The container of claim 1 further comprising a plurality of slots mounted on the container such that the shear bar structures pass through the slots.

6. The container of claim 5, wherein the clearance between each slot and each shear bar structure is about 2.5 mm.

7. The container of claim 1, wherein the maximum size of the solid-ink pellets is about 2 mm.

8. The container of claim 1, wherein the bottom surface of the container is conical in shape.

* * * * *